United States Patent [19]

Burleson

[11] 4,409,889

[45] Oct. 18, 1983

[54] MODULAR CLEAN ROOM

[76] Inventor: Maurice L. Burleson, 8003 Woodglen Cir., La Palma, Calif. 90623

[21] Appl. No.: 317,258

[22] Filed: Nov. 2, 1981

[51] Int. Cl.[3] ..... F24F 7/10

[52] U.S. Cl. ..... 98/33 A; 52/79.1; 55/385 A; 98/31

[58] Field of Search ..... 55/385 A; 98/31, 33 R, 98/33 A, 40 D, 55, 115 LH, 115 SB; 52/79.1, 79.9, 126.6

[56] References Cited

U.S. PATENT DOCUMENTS

| | | | |
|---|---|---|---|
| 2,310,222 | 2/1943 | Deverall | 98/33 A |
| 3,012,493 | 12/1961 | Ekeren | 98/40 D |
| 3,115,819 | 12/1963 | Mahlmeister et al. | 98/31 X |
| 3,158,457 | 11/1964 | Whitfield | 98/33 A X |
| 3,391,630 | 7/1968 | Wilhelmsson | 98/115 SB |
| 3,522,724 | 8/1970 | Knab | 55/385 A X |
| 3,944,405 | 3/1976 | van Calsteren et al. | 98/115 LH X |
| 4,178,159 | 12/1979 | Fecteau | 55/385 A |
| 4,267,769 | 5/1981 | Davis et al. | 98/33 A |

*Primary Examiner*—Albert V. Makay
*Assistant Examiner*—Harold Joyce
*Attorney, Agent, or Firm*—Knobbe, Martens, Olson & Bear

[57] ABSTRACT

A modular clean room is disclosed for maintaining an environment free of particulate contaminants comprising prefabricated modules which are detachably connected to form a self supporting structure having interior space through which filtered air is flowed. The modules include an air circulating module which supplies a flow of filtered air, a duct module in the form of a service corridor which provides a flow path for the recirculation of air within the interior space, and a floor module which provides a raised floor surface through which air can flow, to an underfloor space communicating with the duct module to recirculate filtered air within the room.

4 Claims, 7 Drawing Figures

Fig. 6
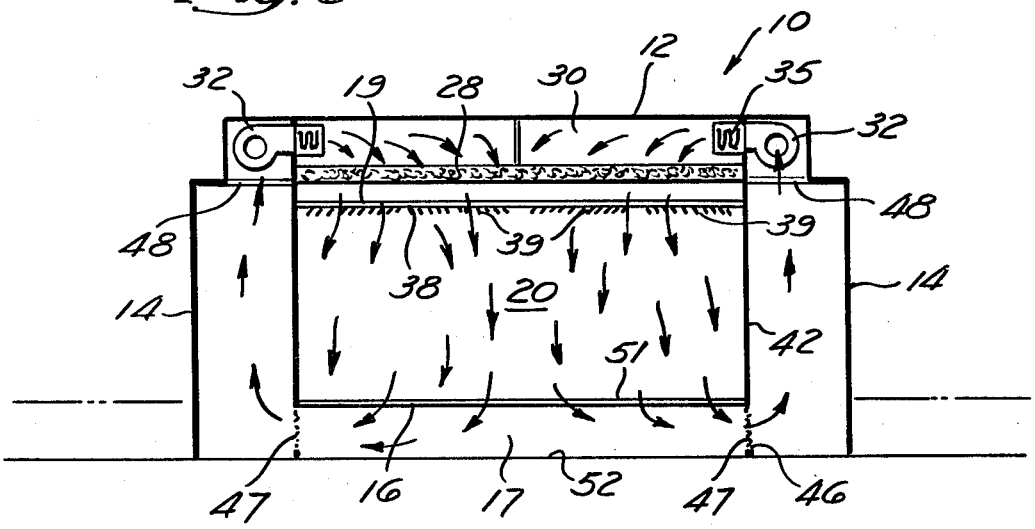
Fig. 7
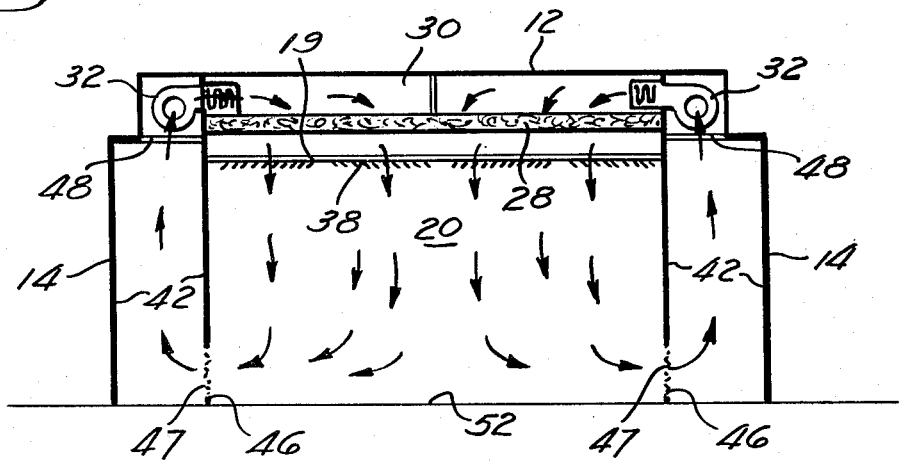
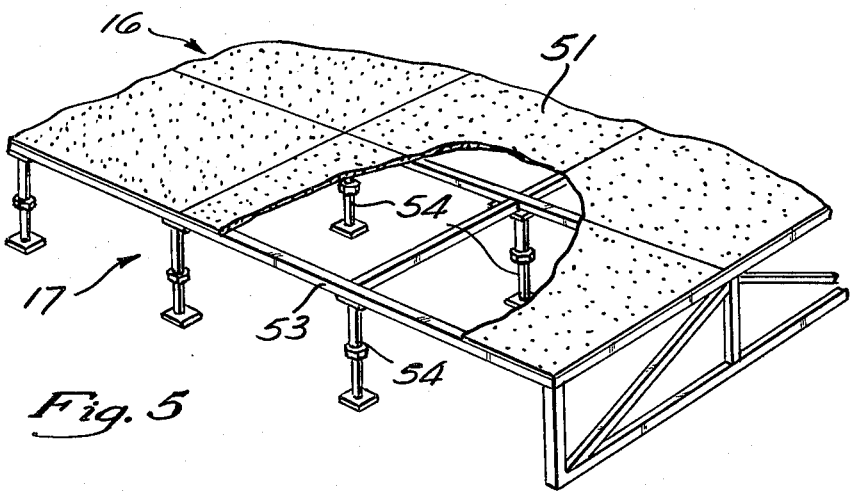
Fig. 5

MODULAR CLEAN ROOM

BACKGROUND OF THE INVENTION

A need has arisen in recent years for manufacturing facilities which can provide an environment free of dust, pollen, bacteria, and other airborne particle contamination. The growing micro-electronic, drug and biomedical industries with their diminishing product geometries, have developed an increased demand for contamination free assembly methods to preclude particulate matter commonly suspended in air.

Common methods for removal of particulate contaminates flow air, which has passed through filtering elements, through the space that must be maintained free of contamination. Pre-filters of various types are often employed to collect larger particles upstream of the higher efficiency filters, thereby increasing the capability and longevity of the filtering system as a whole.

The air filtered of particulate contaminates is flowed through the critical space most commonly in a descending approach. This procedure tends to settle any elusive particulates at lower levels, preferably beneath the work area. However, systems have been employed which flow air in a horizontal path.

Modern techniques limit the air flow velocity to maintain laminar flow characteristics within the critical space of work area. This is accomplished to prevent turbulence which would interrupt the orderly passage of suspended particulates away from the work area, and which could possibly agitate particles which have become settled from the air reintroducing them into the work area. In many applications an air plenum is provided immediately preceeding the filtering elements to decrease the velocity of entering air flow to the filters, and of the particles that are therein suspended. This device allows the filter elements a better opportunity to capture particulates upon their entrance.

Early designs for accomplishing this flow of filtered air through a work area to solve the problem of particulate contamination included a blower filter assembly mounted directly over a work table to force filtered air through the space where operations were being performed. This simple and direct approach of a Clean Work Station was very economical. It could be easily assembled and moved. Its use could be easily expanded to meet the existing requirements of the user simply by purchasing more of them as was necessary. However, in practice they were less than effective if not properly used. Air contaminated with particulates surrounded the area protected in the work station. Exclusion of particulates was maintained solely by the pressure interface of the filtered air flowing into the work area and outwardly against the contaminated air surrounding. While a worker was standing and working with very little motion the clean work station would maintain a sufficiently decontaminated area. But with air flows of a velocity low enough to prevent turbulence, contaminating particles could easily be introduced into the work area from the surrounding environment. Movement into and around the work area could cause infiltration of contaminated air. Persons walking by could introduce contaminating particles to the work area from the dirty walkway between.

Also, effectiveness of air filtering was compromised in these Clean Work Stations since the filters through which air was flowed were continually being required to function in unfiltered air. It is known that the effectiveness of the filters can certainly be improved by recirculation, however this can be counter-productive for clean work stations because it results in a decreased volume of air being expelled from the work area to the surroundings. This in turn decreases the effectiveness of the pressure interface maintaining the segregation between the protected area and the surrounding air. It becomes more permeable to particulate matter. With less resistance to an influx of particulates the likelihood of contamination of the work area increases.

These deficiencies in Clean Work Station performance often resulted in the contamination of the work product. Consequently, improvement was attempted by the addition of blower filter assemblies to the room in which the stations were positioned. These would circulate filtered air into the walkway areas surrounding the work stations. However, the addition of these blower filter assemblies gave rise to new problems. It was very difficult to maintain a balance between the air flows of the work stations and the walkways to maintain the desired flow path for particle travel. The level of contamination in the areas surrounding the work stations were still much higher than satisfactory. The desultory positioning of the numerous blower-filter assemblies in the room created pockets of particle accumulation. Contamination infiltration problems still remained though at diminished levels.

In some instances these modifications actualy compounded contamination problems because persons using the Clean Work Stations believed the surrounding areas to be sufficiently free of contaminates to obviate the need for precautionarypractices. Lack of care led to contaminates being directly introduced to the work area.

The next step was to upgrade the entire room enclosing a group of work areas to a contamination free condition. This of course was a very expensive approach to the problem, requiring not only the purchase of specialized equipment but also requiring specialized architectural design and craftwork. The construction of such a structure took considerable time. First engineers and architects were required to design the structure. Building permits and inspections were then required before its construction could begin. Materials had to be purchased and delivered. It was necessary to negotiate contracts for the structure's construction, and for installation of electrical wiring, plumbing, sheetmetal duct work, and air conditioning. More importantly, the final construction was more or less permanent. Building plans had to be drawn taking into account future expansions and changes in work requirements if the Clean Room was to be versatile. This was particularly troublesome where it was necessary to build the Clean Room with another room in order to isolate a particular work area, especially for manufacturers who because of their changing product lines and changing demands could not accurately anticipate their changing needs. It was extremely expensive procedure to expand a permanently constructed Clean Room structure or to relocate it to a different area.

Though these structures were effective, it can be seen they were not desirable in many circumstances. A need, therefore, remained for an effective and flexible design of a Clean Room type structure which could be easily installed, expanded to meet changing requirements, and inexpensively fabricated, yet capable of maintaining a specified class of cleaniness for a work area.

SUMMARY OF THE INVENTION

The present invention provides a Clean Room structure which solves the above mentioned problems, and has many advantages not found in the prior art. The Clean Room is comprised of discrete prefabricated modules, including an air circulating module and a duct module. The preferred embodiment will also include a wall module, a ceiling module, and a floor module. These modules are detachably assembled in a building-block arrangement to form an interior space to be used as a work area. Filtered air is flowed through this room in its entirety to remove particulates providing a work environment completely free of contamination. Work stations with or without individual filtering apparatus may be positioned within, in any order, without any concern of particulate infiltration.

The air circulating module includes a blower assembly and a filter assembly which provides the flow of filtered air to the interior space of the Modular Clean Room. It is designed to provide the proper air flow and filtering performance necessary for the application in which it is used. The module is preferrably positioned as part of the structure of the modular room, as for example in a position overhead to serve as the ceiling structure for the room. The air circulating module is designed and built from heavy duty structural tubing, and preferably consists of separate structural units for the filter assembly and the blower assembly so that they may be individually removed. It includes a plenum area between the blower assemblies and the filter assemblies to slow the air flow velocity entering the filters for the benefits previously described. When placed overhead the module may also include diffusers to direct the air flow into the interior space so that uniform distribution can be maintained or the air flow directed to special areas. It is designed to be capable of providing zone control of air temperature and humidity to very close tolerance where required. The overhead mounting of the structure provides support for ceiling fixtures and panels.

The duct module is designed as an intregal part of the Modular Clean Room to provide a flow path for the recirculation of the air within the interior of the room to the air circulating module. This module is provided with pre-filter systems for advantages previously described in the prior art. It can be placed to serve two side-by-side word areas forming a common structure between them. In a preferred embodiment,the duct module will be comprised of a tubular frame which can be anchored to the floor, to which wall panels are attached to form a service corridor which extends along the length of the modular room. A service corridor can be positioned on one or more sides of a modular structure, or may be placed to form a common wall structure. Air is flowed through the service corridor structure from entry ports in a lower portion which are provided with the prefilters, to the air circulating module which is positioned above these corridor structures and supported by them. The duct module in a service corridor configuration provides an area in which utility services may be located, such as water, air, drain and vacuum piping and electrical conduit. It also provides a housing for peripheral process equipment, such as pumps or process controls, so that servicing of these items can be performed outside of the clean work area.

A floor module can be included in a Modular Clean Room assembly which comprises a raised floor supported by a suitable structure. It provides an underfloor space where utility services may be located or which may be used as an air flow duct. In a preferred embodiment, the floor panels are provided with a plurality of perforations through which air may flow to the underfloor space so that a uniform air flow distribution may be maintained within the interior space of the modular room. Air flowing through the floor is then directed to entry openings of one or more duct modules at the outer boundaries of the floor surface. Dampers may be provided in the underfloor area so that air flow may be optimally balanced throughout the work area.

An end wall section module may be provided to enclose the interior space of the Modular Clean Room. The wall module preferably includes a means for entry and exit from the work area which will protect the work area from infiltration of contaminates. The wall module may be comprised of a plurality of sections so that it may be expanded or made smaller as the need may arise.

Additionally, modules or modular packages can be provided to the user for ceiling sections, for diffusers to be placed in the ceiling, for lighting, for temperature and humidity control and for static neutralizing systems.

The modular design construction of this structure provides a simple, versatile, and cost effective way of providing a full laminar flow Clean Room where particulate contaminates must be removed from the environment. The Modular Clean Room solves the problems associated with work stations placed outside of a completely contamination free environment without requiring specialized equipment or services. It provides the user a completely pre-engineered system. The user may select the type of module necessary to maintain the specific class of cleanliness his operations require.

This modular design allows the user to assemble a Clean Room structure at a much lower cost and in much less time. He will no longer have to build costly custom structures. The prefabricated modules come in a variety of sizes offering a user the capability of constructing Clean Room facilities of different sizes and capacities by simply selecting and assembling the necessary individual modules. Their structure allows assembly of the Modular Clean Room by a simple fastened together method. Its assembly can be performed by ordinary maintenance personnel or by the manufacturer representatives, thereby obviating the need for specialized craft workers. The assembled modular structure provides a free standing room of a rigid construction.

The modular structure may be easily expanded by the addition of more modules, or easily relocated by simply disassembling the structure, moving the component modules, and reassembling the modules at a new location. These advantages provide great flexibility for the user, with a minimum of effort and cost, and the capability of long term use of the individual modules as the configurations of the user's Clean Rooms may change.

DESCRIPTION OF THE DRAWINGS

FIG. 5 is a fragmentary view showing a raised floor module, the frame work supporting the floor, and a lower portion of the duct module at the edge of the floor;

FIG. 6 is a plan view of the air flow through a Modular Clean Room including a raised floor module;

FIG. 7 is a plan view showing the air flow through a Modular Clean Room without a raised floor module.

DETAILED DESCRIPTION OF THE PREFERRED EMBODIMENT

Figure 1:
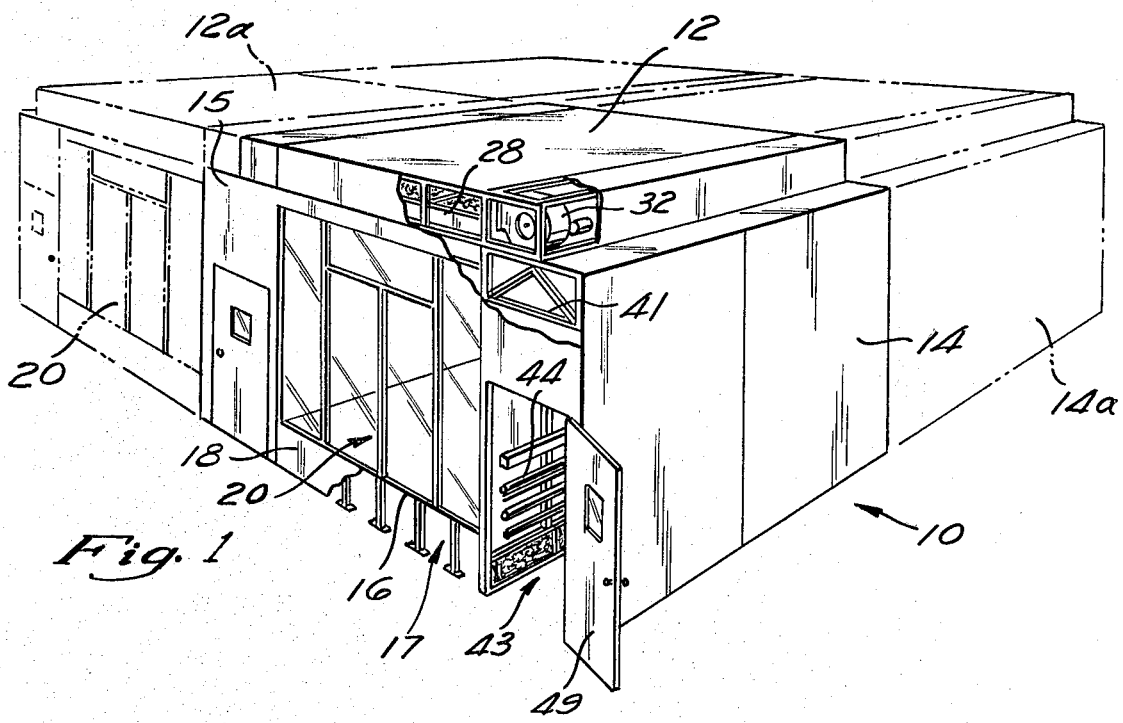
FIG. 1 is a perspective view of a Modular Clean Room with cut-away sections to show the filter assembly and the blower assembly of the air circulating module, the duct module framework and the floor module frame work.
Figure 2:
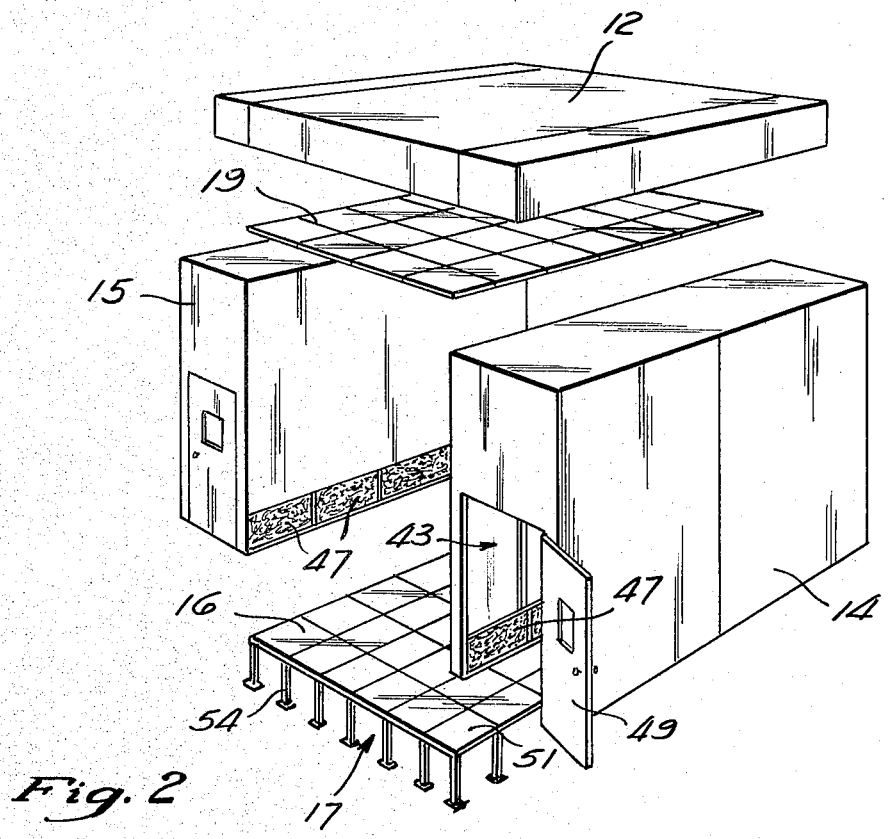
FIG. 2 is an exploded perspective view of a Modular Clean Room depicting the individual module of which it is comprised.

Referring first to FIGS. 1 and 2 there is shown a Modular Clean Room 10, including air circulating modules 12, duct modules 14 in the form of a service corridor, raised floor modules 16, an end wall module 18, and ceiling modules 19. FIG. 1 shows these modules in assembled position, with work areas 20 positioned side by side. FIG. 2 shows the individual modules prior to assembly. The Modular Clean Room 10 is comprised of a duct module 14 positioned along each side of the work area 20. An air circulating module 12 is positioned overhead and supported by the duct module structure. An end wall module 18 extends between the duct modules 14 to enclose the interior space of the work area 20. A raised floor module 16 is included extending between the duct module 14, defining an underfloor area 17. The structure of the air circulating module 12 supports an underlaying ceiling module 19 positioned between the duct modules 14.

Successive duct and air circulating modules, 14, 14*a*, and 12, 12*a* respectively, are positioned end to end to form a large work area 20. Modular Clean Rooms 10 may also be positioned side by side as is shown in FIG. 1 using a common duct module 15 as a party wall service corridor. When fastened together the modules form a self-supporting free standing enclosure which surrounds the work area, that can be easily assembled by known removable fastening techniques.

Figure 3:
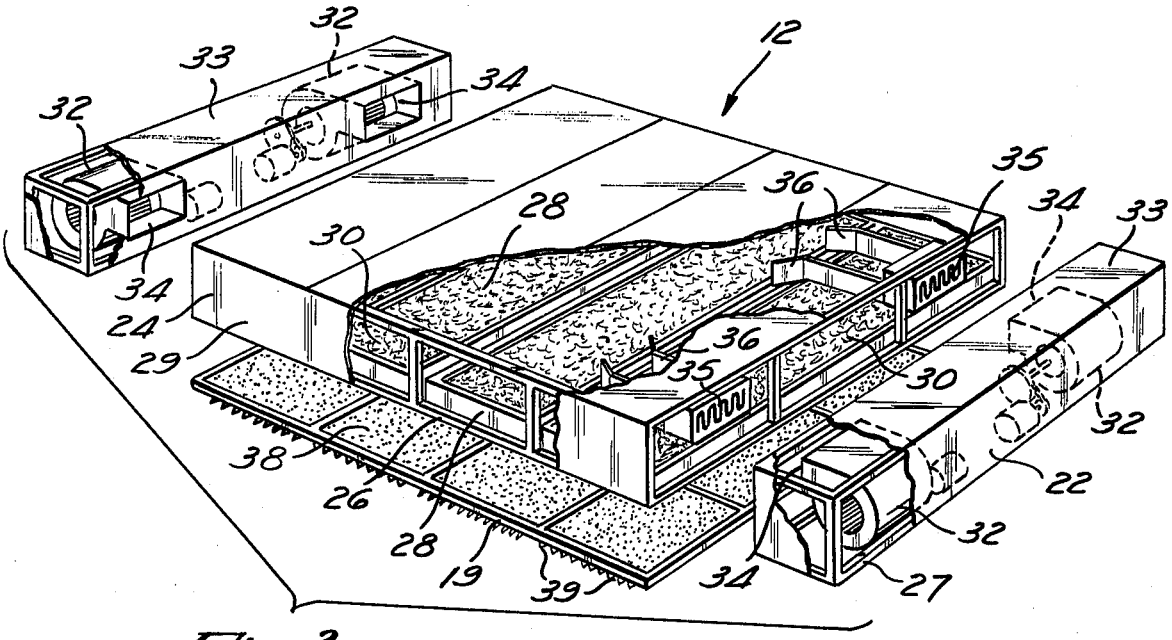
FIG. 3 is an exploded perpective view showing an air circulating module with cut-away sections and phantom images showing the blower assembly and the filter assembly.

The air circulating module 12 is comprised of a blower assembly 22 and a filter assembly 24 as is seen in FIG. 3. A tubular framework is provided which has two distinct and severable frame portions 26 and 27. The first frame portion 26 has mounted to it a purality of filters 28 positioned at its lower face so that air flows through them in a generally downwardly direction. A surface covering 29 is attached to two sides and the upper face of the framework 26 which provides a plenum chamber 30 directly above the filters 28. A pair of second framework portions 27 are attached to opposing sides of the first framework portion 26. On the second framework portion 27 a purality of blower units 32 are mounted, positioned to force air in a generally inwardly direction into the plenum chamber 30. The second framework 27 has surface coverings 33 attached to it so that air will enter into the space within framework 27 from a generally lower area to enter the blower units 32 and be forced out a blower outlet 34 facing inwardly.

An optional air conditioning unit 35 to provide for control of air temperture and humidity may be included as is shown in FIG. 3, where this unit is positioned immediately adjacent a blower outlet 34. Air flow directing elements 36 are included for zone control of air flow and conditions within the work area.

A ceiling module 19 underlying the air circulating module is provided, preferably supported by the air module framework 26. The ceiling surface 38 is designed so that air flowing from the filters 28 immediately above, may pass through to the work area 20 below in a uniform manner. Diffuser elements 39 may be positioned in the structure of the ceiling module 19 to direct air flow to specific areas within the work area 20.

Figure 4:
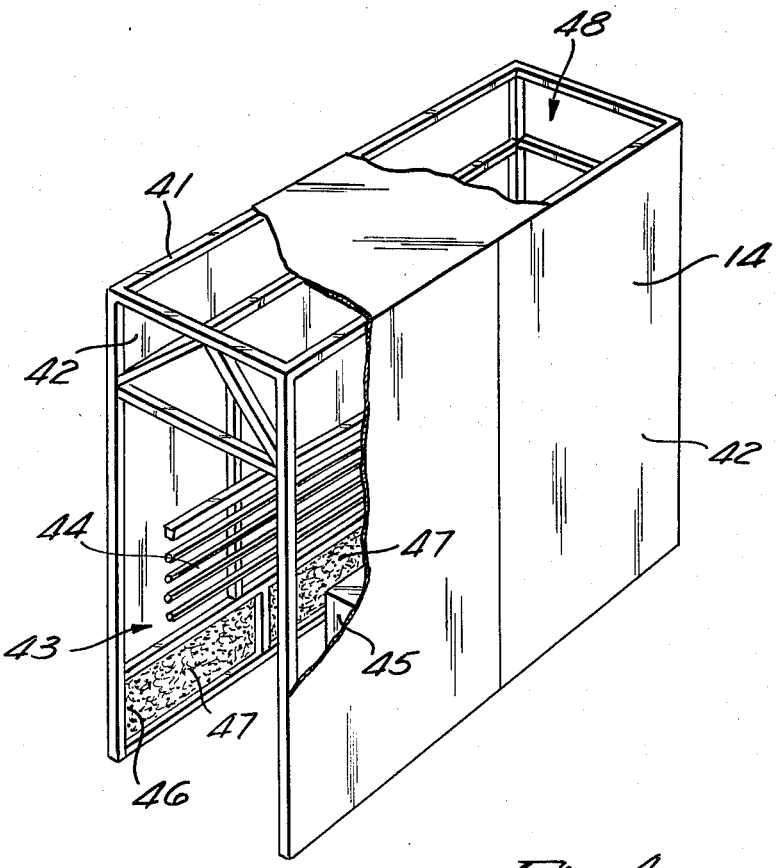
FIG. 4 depicts a duct module in the preferred form of a service corridor showing in a cut-away the framework and pre-filters in a lower portion.

The air circulating module 12 is positioned above and supported by one or more duct modules 14 as are depicted in FIG. 4. The duct module 14 comprises a tubular frame 41 which has wall panels 42 attached to its sides to form a corridor. This service corridor provides a passageway 43 in which utility services and connections 44 may be placed. There is also room for the placement of process peripheral equipment 45. At a lower portion of the framework 41 an air inlet 46 is formed. Pre-filter assemblies 47 are positioned in the air inlet 46. The top of the tubular framework 41 forms an air exit 48 through which air may flow to the air circulating module 12. Preferably, the air circulating module 12 is positioned to rest on the tubular framework 41 of the duct module 14 with the blower units 32 positioned directly above the air exit 48 so that air may flow directly through the duct module into the blower inlets. The duct module 14 in the form of a service corridor is provided with a door 49, as seen in FIG. 1.

Referring to FIG. 5, the floor module 16 includes a raised floor 51 which is positioned above a floor 52 by an adjustable framework structure 53. The floor 51 is supported by a number of adjustable stands 54 which connect to the framework 53. A purality of perforations are made through the floor 51 so that air may pass through to an underfloor space 17. The floor 51 extends to the wall 42 of a duct module 14 so that the air inlet 46 in the duct module is positioned to communicate with the underfloor space 17 to receive air from the work area 20.

Air is flowed through the assembled Modular Clean Room 10 as is shown in FIGS. 6 and 7. FIG. 6 depicts the air flow path of a modular room having a floor module 16 included. Air enters the duct module 14 through the air inlet 46 at its lower portion and passes through a pre-filter 47. The air flows upwardly through the duct module 14 to an air exit 48, and into the air circulating module 12. Air is pulled into an air inlet of a blower unit 32 and forced into the plenum chamber 30 area defined within the air circulating module 12 above the filters 28. The air then proceeds downwardly through the filters 28 and through the ceiling surface 38 into the work area 20. The ceiling modules 19 may include diffusers 39 to direct the air flow to specific areas. The air flows through the work area 20 in a descending manner to maintain residual particulates near the floor surface 51. The air continues through the perforations in the floor surface 51 to the underfloor space 17 and returns through the underfloor area to the air inlets 46 of the duct module 14.

FIG. 7 depicts the air flow path through a room without a floor module. The air flow path is the same as with a floor module with the exception that the air inlet 46 to the duct module 14 is positioned just above the base floor 52. Airflows through the room in a descending manner and along the floor 52 to the air entry 46 of the duct module 14.

What is claimed in:

1. A clean room made of prefabricated modules comprising:

a pair of duct modules spaced from each other to define a work space between them, each module having a tubular box-like frame outlining a pair of spaced side walls, a pair of end walls, and a ceiling, and panels attached to the frame to define a self-supported, closed service corridor, and including a door in one of the panels for entering the corridor, at least one of said duct modules having an air inlet at a lower level and an air exit at an upper level, the air inlet being formed in the panel adjoining the work space;

an air circulating module having a box-like, tubular frame extending over the space between the duct modules and supported overhead by the duct modules, panels attached to said air circulating frame and enclosing the top and side walls of the air circulating module, the air circulating module further including a blower assembly mounted to said air circulating frame, positioned adjacent to and in communication with said air exit, said air circulating module further including a filter assembly positioned in the lower portion of said air circulating frame and extending over said work space so that air from the blower assembly is directed inwardly between the upper panel of the air circulating module and downwardly through the filter assembly; and wall panels cooperating with said modules to complete the enclosure of the interior work space with said air inlets of the duct modules being open to said space so that air flowing from the filter assembly will pass through said space in a descending manner to said duct module air inlet, wherein the air is directed upwrdly in said duct modules through said air exit leading to the blower assembly.

2. The clean room of claim 1, including a floor module comprising a raised floor surface through which air flows, positioned between said duct modules and supported by an adjustable framework, said surface defining an under-floor space which communicates with the air inlets of said duct modules to flow air from the work space through the floor moldule to the duct modules.

3. The clean room of claim 1 wherein both duct modules have an air inlet open to said work space and an air exit, and said air circulating module includes a pair of blower assemblies, one adjacent to each of the duct modules in communication with the air exit of the adjacent module, whereby the air from both blower assemblies flows downardly into the work space and air is returned to the blower assemblies through both the duct modules.

4. The clean room of claim 3 wherein said air circulating module frame includes a separate frame portion respectively supporting each of the blower assemblies and a separate frame portion supporting the filter assembly, and wherein each of said frame portions are joined to form a single rigid air circulating module frame.

* * * * *